US006787025B2

(12) United States Patent
Mukherjee et al.

(10) Patent No.: US 6,787,025 B2
(45) Date of Patent: Sep. 7, 2004

(54) PROCESS FOR THE PRODUCTION OF HIGH QUALITY MIDDLE DISTILLATES FROM MILD HYDROCRACKERS AND VACUUM GAS OIL HYDROTREATERS IN COMBINATION WITH EXTERNAL FEEDS IN THE MIDDLE DISTILLATE BOILING RANGE

(75) Inventors: Ujjal Kumar Mukherjee, Montclair, NJ (US); Wai Seung W. Louie, Brooklyn, NY (US); Arthur J. Dahlberg, Benicia, CA (US)

(73) Assignee: Chevron U.S.A. Inc., San Ramon, CA (US)

( * ) Notice: Subject to any disclaimer, the term of this patent is extended or adjusted under 35 U.S.C. 154(b) by 132 days.

(21) Appl. No.: 10/025,411

(22) Filed: Dec. 17, 2001

(65) Prior Publication Data

US 2003/0111387 A1 Jun. 19, 2003

(51) Int. Cl.[7] ..... C10G 45/00

(52) U.S. Cl. ..... 208/89; 208/105; 208/57; 208/58; 208/59; 208/83

(58) Field of Search ..... 208/89, 57, 58, 208/59, 83, 100, 105

(56) References Cited

U.S. PATENT DOCUMENTS

| | | | |
|---|---|---|---|
| 2,671,754 A | 3/1954 | Watkins et al. | |
| 5,114,562 A | 5/1992 | Haun | |
| 5,980,729 A | 11/1999 | Kalnes et al. | 208/89 |
| 6,106,694 A | 8/2000 | Kalnes et al. | 208/57 |
| 2003/0111386 A1 * | 6/2003 | Mukherjee et al. | 208/58 |

FOREIGN PATENT DOCUMENTS

| | | | |
|---|---|---|---|
| EP | 0 321 713 A | 6/1989 | |
| WO | 97/38066 | 10/1997 | C10G/65/12 |
| WO | WO 01 42396 A | 6/2001 | |

* cited by examiner

*Primary Examiner*—Walter D. Griffin
*Assistant Examiner*—James Arnold, Jr.
(74) *Attorney, Agent, or Firm*—Penny L. Prater

(57) ABSTRACT

In the refining of crude oil, vacuum gas oil hydrotreaters and hydrocrackers are used to remove impurities such as sulfur, nitrogen, and metals from the crude oil. Typically, the middle distillate boiling material (boiling in the range from 250° F.–735° F.) from VGO hydrotreating or moderate severity hydrocrackers does not meet the smoke point, the cetane number or the aromatic specification. In most cases, this middle distillate is separately upgraded by a middle distillate hydrotreater or, alternatively, the middle distillate is blended into the general fuel oil pool or used as home heating oil. With this invention, the middle distillate is hydrotreated in the same high pressure loop as the vacuum gas oil hydrotreating reactor or the moderate severity hydrocracking reactor. The investment cost saving and/or utilities saving are significant since a separate middle distillate hydrotreater is not required A major benefit of this invention is the potential for simultaneously upgrading difficult cracked stocks such as Light Cycle Oil, Light Coker Gas Oil and Visbroken Gas Oil or Straight-Run Atmospheric Gas Oils utilizing the high-pressure environment required for mild hydrocracking.

15 Claims, 2 Drawing Sheets

PROCESS FOR THE PRODUCTION OF HIGH QUALITY MIDDLE DISTILLATES FROM MILD HYDROCRACKERS AND VACUUM GAS OIL HYDROTREATERS IN COMBINATION WITH EXTERNAL FEEDS IN THE MIDDLE DISTILLATE BOILING RANGE

FIELD OF THE INVENTION

This invention is directed to processes for upgrading the fraction boiling in the middle distillate range which is obtained from VGO hydrotreaters or moderate severity hydrocrackers. This invention involves a multiple-stage process employing a single hydrogen loop.

BACKGROUND OF THE INVENTION

In the refining of crude oil, vacuum gas oil hydrotreaters and hydrocrackers are used to remove impurities such as sulfur, nitrogen, and metals from the crude oil. Typically, the middle distillate boiling material (boiling in the range from 250° F.–735° F.) from VGO hydrotreating or moderate severity hydrocrackers does not meet the smoke point, the cetane number or the aromatic specification. In most cases, this middle distillate is separately upgraded by a middle distillate hydrotreater or, alternatively, the middle distillate is blended into the general fuel oil pool or used as home heating oil. There are also streams in the diesel boiling range, from other units such as Fluid Catalytic Cracking, Delayed Coking and Visbreaking that require upgrading. Very often, existing diesel hydrotreaters are not designed to the pressure limits required to process these streams and the mild hydrocracking unit provides an opportunity for simultaneous upgrading of these streams.

There have been some previously disclosed processes in which hydroprocessing occurs within a single hydroprocessing loop. International Publication No. WO 97/38066 (PCT/US97/04270), published Oct. 16, 1997, discloses a process for reverse staging in hydroprocessing reactor systems. This hydroprocessor reactor system comprises two reactor zones, one on top of the other, in a single reaction loop. In the preferred embodiment, a hydrocarbon feed is passed to a denitrification and desulfurization zone, which is the lower zone. The effluent of this zone is cooled and the gases are separated from it. The liquid product is then passed to the upper zone, where hydrocracking or hydrotreating may occur. Deeper treating preferably occurs in the upper zone.

U.S. Pat. No. 5,980,729 discloses a configuration similar to that of WO 97/38066. A hot stripper is positioned downstream from the denitrification/desulfurization zone, however. Following this stripper is an additional hydrotreater. There is also a post-treat reaction zone downstream of the denitrification/desulfurization zone in order to saturate aromatic compounds. U.S. Pat. No. 6,106,694 discloses a similar configuration to that of U.S. Pat. No. 5,980,729, but without the hydrotreater following the stripper and the post-treat reaction zone.

SUMMARY OF THE INVENTION

With this invention, the middle distillate is hydrotreated in the same high pressure loop as the vacuum gas oil hydrotreating reactor or the moderate severity hydrocracking reactor, but the reverse staging configuration employed in the references is not employed in the instant invention. The investment cost saving and/or utilities saving involved in the use of a single hydrogen loop are significant since a separate middle distillate hydrotreater is not required. Other advantages include optimal hydrogen pressures for each step, as well as optimal hydrogen consumption and usage for each product. There is also a maximum yield of upgraded product, without the use of recycle liquid. The invention is summarized below.

A method for hydroprocessing a hydrocarbon feedstock, said method employing at least two reaction zones within a single reaction loop, comprising the following steps:

(a) passing a hydrocarbonaceous feedstock to a first hydroprocessing zone having one or more beds containing hydroprocessing catalyst, the hydroprocessing zone being maintained at hydroprocessing conditions, wherein the feedstock is contacted with catalyst and hydrogen;

(b) passing the effluent of step (a) directly to a hot high pressure separator, wherein the effluent is contacted with a hot, hydrogen-rich stripping gas to produce a vapor stream comprising hydrogen, hydrocarbonaceous compounds boiling at a temperature below the boiling range of the hydrocarbonaceous feedstock, hydrogen sulfide and ammonia and a liquid stream comprising hydrocarbonaceous compounds boiling approximately in the range of said hydrocarbonaceous feedstock;

(c) passing the vapor stream of step (b), after cooling and partial condensation, to a hot hydrogen stripper containing at least one bed of hydrotreating catalyst, where it is contacted countercurrently with hydrogen, while the liquid stream of step (b) is passed to fractionation;

(d) passing the overhead vapor stream from the hot hydrogen stripper of step (c), after cooling and contacting with water, the overhead vapor stream comprising hydrogen, ammonia, and hydrogen sulfide, along with light gases and naphtha to a cold high pressure separator, where hydrogen, hydrogen sulfide and light hydrocarbonaceous gases are removed overhead, ammonia is removed from the cold high pressure separator as ammonium bisulfide in the sour water stripper, and naphtha and middle distillates are passed to fractionation;

(e) passing the liquid stream from the hot hydrogen stripper of step (c) to a second hydroprocessing zone, the second hydroprocessing zone containing at least one bed of hydroprocessing catalyst suitable for aromatic saturation and ring opening, wherein the liquid is contacted under hydroprocessing conditions with the hydroprocessing catalyst, in the presence of hydrogen;

(f) passing the overhead from the cold high pressure separator of step (d) to an absorber, where hydrogen sulfide is removed before hydrogen is compressed and recycled to hydroprocessing vessels within the loop; and (g) passing the effluent of step (e) to the cold high pressure separator of step (d).

DETAILED DESCRIPTION OF THE INVENTION

Description of the Preferred Embodiment

Figure 1:
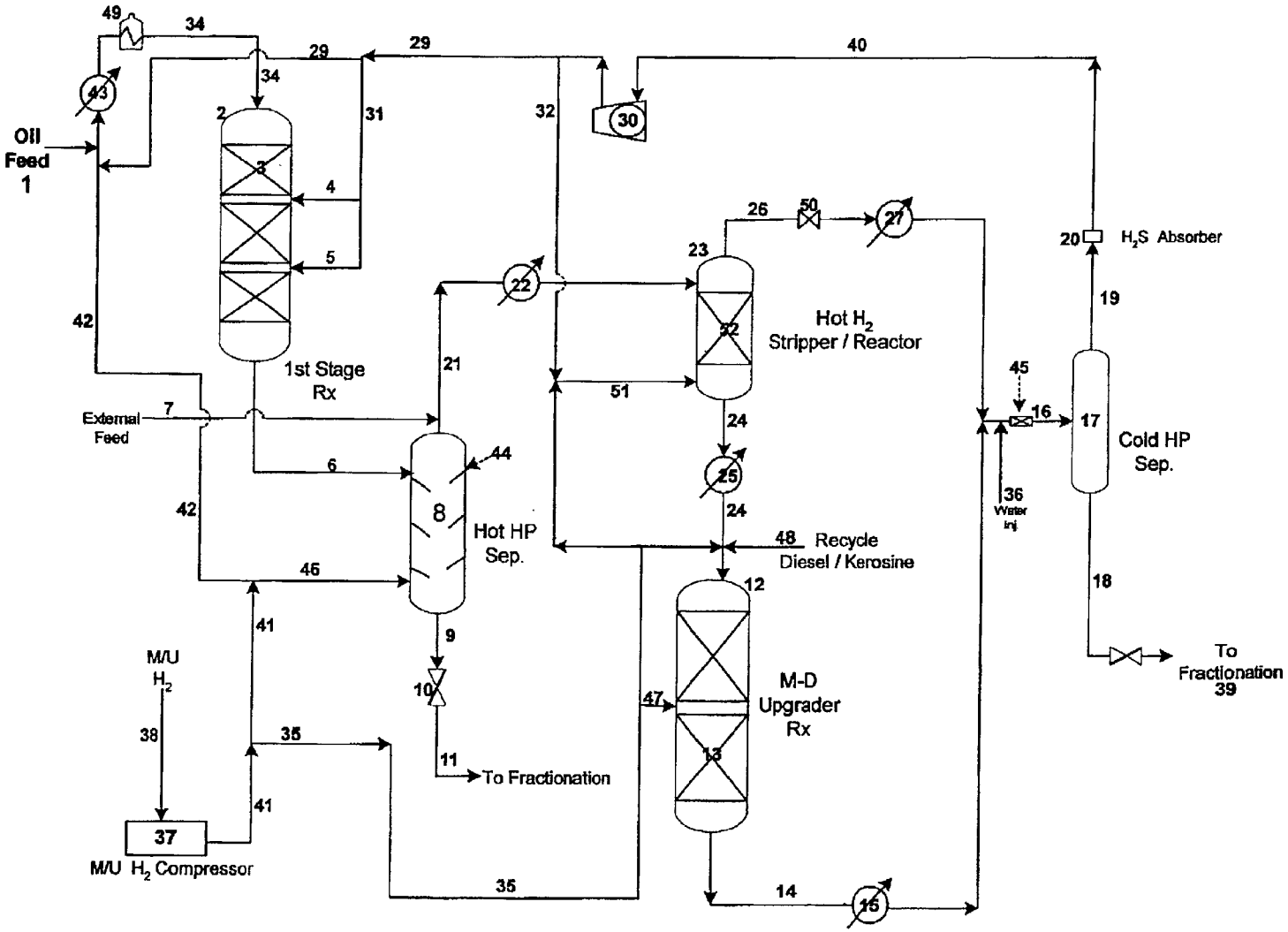
FIG. 1 illustrates a hydroprocessing loop in which the post-treatment reactor is a middle distillate upgrader which operates at approximately the same pressure as the first stage reactor.

Description of FIG. 1

Feed in stream 1 is mixed with recycle hydrogen and make-up hydrogen in stream 42. The feed has been preheated in a process heat exchanger train, as are the gas streams. The mixture of feed and gas, now in stream 34, is further heated using heat exchangers 43 and furnace 49. Stream 34 then enters the first stage downflow fixed bed reactor 2. The first bed 3 of reactor 2 may contain VGO hydrotreater catalyst or a moderate severity hydrocracker catalyst. There may be a succession of fixed beds 3, with interstage quench streams, 4 and 5 delivering hydrogen in between the beds.

The effluent 6 of the first stage reactor 2, which has been hydrotreated and partially hydrocracked, contains hydrogen sulfide, ammonia, light gases, naphtha, middle distillate and hydrotreated vacuum gas oil. The effluent enters the hot high pressure separator or flash zone 8 at heavy oil reactor effluent conditions where part of the diesel and most of the lighter material is separated from the unconverted oil. The hot high pressure separator has a set of trays 44 with hydrogen rich gas introduced at the bottom for stripping through stream 46.

Stream 9 is primarily hydrotreated heavy gas oil, boiling at temperatures greater than 700° F. The valve 10 indicates that pressure is reduced before the unconverted oil is sent to the fractionation section in stream 11.

Stream 21 contains the overhead from the hot high pressure separator. Stream 21 is cooled in exchanger 22 (by steam generation or process heat exchange) before entering the hot hydrogen stripper/reactor 23. Stream 21 flows downwardly through a bed of hydrotreating catalyst 52, while being contacted with countercurrent flowing hydrogen from stream 51.

The overhead stream 26 contains hydrogen, ammonia and hydrogen sulfide, along with light gases and naphtha. The differential operating pressure between the hot hydrogen stripper/reactor 23 and cold high pressure separator 17 is maintained by control valve 50. Stream 26 is cooled in exchanger 27 and joins stream 14 to form stream 16. Water is injected (stream 36) into the stream 16 to remove most of the ammonia as ammonium bisulfide solution (ammonia and hydrogen sulfide react to form ammonium bisulfide which is converted to solution by water injection). The stream is then air cooled by cooler 45. The stream 16 enters the cold high pressure separator 17. Hydrogen, light hydrocarbonaceous gases, and hydrogen sulfide are removed overhead through stream 19. Hydrogen sulfide is removed from the stream in the hydrogen sulfide absorber 20. Ammonia and hydrogen sulfide are removed with the sour water stream (not shown) from the cold high pressure separator 17.

Stream 40, which contains hydrogen-rich gas, is compressed in compressor 30 and splits into streams 29 and 32. Stream 32 passes to the hot hydrogen stripper/reactor 23. Stream 31 is diverted from stream 29 for use as interstage quench. Streams 4 and 5 are diverted from stream 31. Stream 29, containing hydrogen, is combined with hydrogen stream 42 prior to combining with oil feed stream 1.

Make-up hydrogen 38 is compressed and sent to four separate locations, upstream of reactor 2 to combine with feed stream 1 (through stream 42), to the hot high pressure separator 8 through stream 46, to the hot hydrogen stripper/reactor through stream 51, and to the middle distillate upgrader (stream 35) to combine with recycle diesel or kerosene or to be used as interstage quench. Stream 38, containing make-up hydrogen, passes to the make-up hydrogen compressor 37. From stream 41, which exits compressor 37 containing compressed hydrogen, streams 35, 42 and 46 are diverted.

The middle distillate upgrader 12 consists of one or more multiple beds 13 of hydrotreating/hydrocracking catalyst (such as Ni—Mo, Ni—W and/or noble metal) for aromatic saturation and ring opening to improve diesel product qualities such as aromatic level and cetane index. In the embodiment of FIG. 1, the middle distillate upgrader is operated at approximately the same pressure as the first stage reactor 2. Quench gas (stream 47) may be introduced in order to control reactor temperature. Stream 24 may be combined with recycle diesel or kerosene (stream 48) from the fractionator when no other external feeds (stream 7) are to be processed and cooled in exchanger 25. Hydrogen from stream 35 is combined with stream 24 prior to entering the middle distillate upgrader 12. Stream 24 enters the reactor at the top and flows downwardly through the catalyst beds 13.

Stream 14, which is the effluent from the middle distillate upgrader 12, is used to heat the other process streams in the unit (see exchanger 15) and then joins with stream 26 to form stream 16, which is sent to the effluent air cooler and then to the cold high-pressure separator 17. Water is continuously injected into the inlet piping of the effluent air cooler to prevent the deposition of salts in the air cooler tubes. In the cold high pressure separator 17, hydrogen, hydrogen sulfide and ammonia leave through the overhead stream 19, while naphtha and middle distillates exit through stream 18 to fractionation (stream 39).

Figure 2:
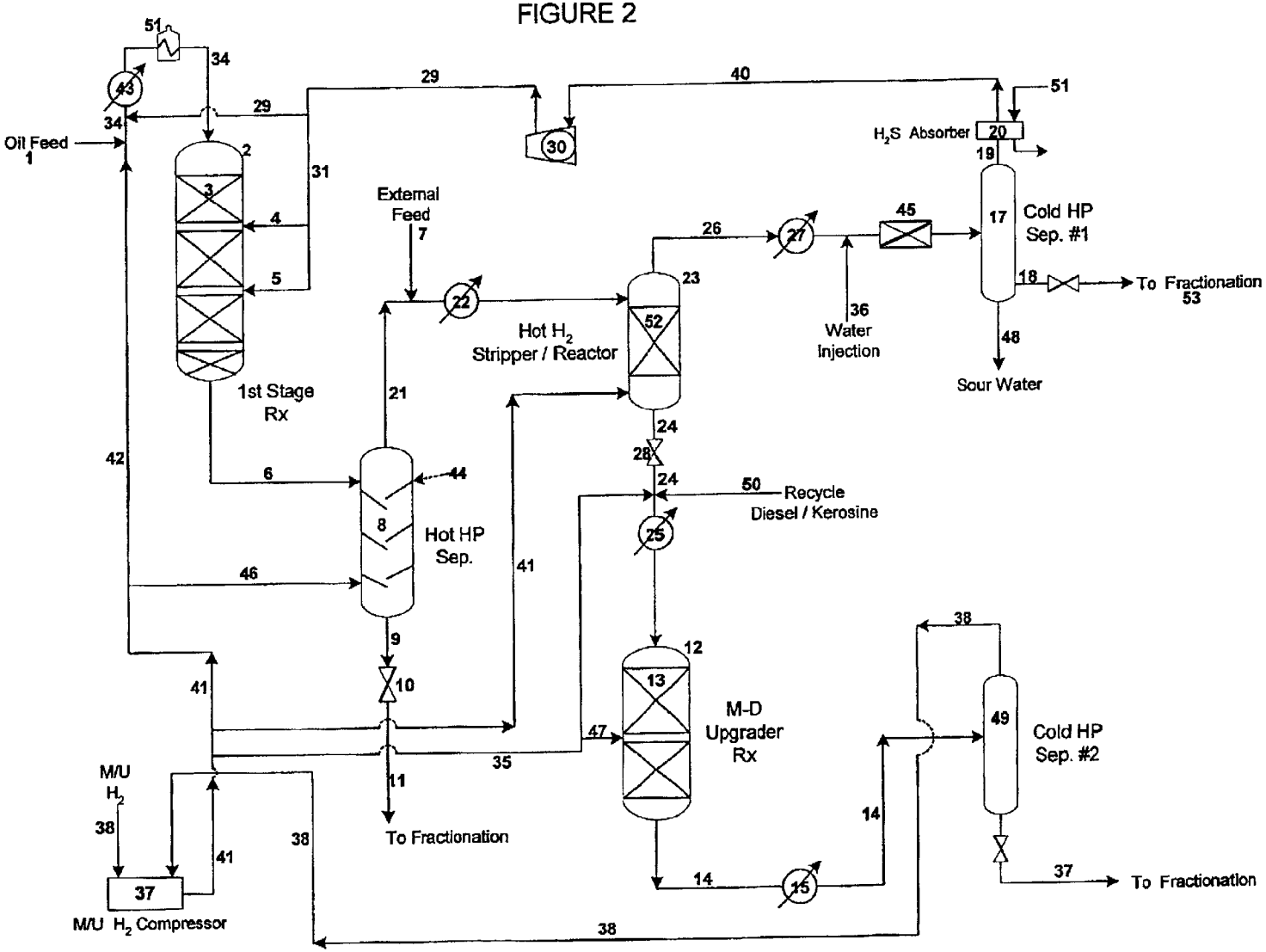
FIG. 2 illustrates a hydroprocessing loop in which the post-treatment reactor is the same as that of FIG. 1, but operates at lower pressure than the first stage reactor. A noble metal catalyst is used in the post-treatment reactor.

Description of FIG. 2

As described in FIG. 1, feed in stream 1 is mixed with recycle hydrogen and make-up hydrogen in stream 42. The feed has been preheated in a process heat exchange train as are the gas streams. The mixture of feed and gas, now in stream 34, is further heated using heat exchangers 43 and furnace 51. Stream 34 then enters the first stage downflow fixed bed reactor 2. The first bed 3 of reactor 2 may contain VGO hydrotreater catalyst or a moderate severity hydrocracker catalyst. There may be a succession of fixed beds 3, with interstage quench streams, 4 and 5 delivering hydrogen in between the beds.

The effluent 6 of the first stage reactor, which has been hydrotreated and partially hydrocracked, contains hydrogen sulfide, ammonia, light gases, naphtha, middle distillate and hydrotreated vacuum gas oil. The effluent enters the hot high pressure separator or flash zone 8 at heavy oil reactor effluent conditions where part of the diesel and most of the lighter material is separated from the unconverted oil. The hot high pressure separator has a set of trays 44 with hydrogen rich gas introduced at the bottom for stripping through stream 46.

Stream 9 is primarily hydrotreated heavy gas oil, boiling at temperatures greater than 700° F. The valve 10 indicates that pressure is reduced before the unconverted oil is sent to the fractionation section in stream 11.

Stream 21 contains the overhead from the hot high pressure separator and 33 may be joined by external feed 7. Stream 21 is then cooled in exchanger 22 (by steam generation or process heat exchange) before entering the hot hydrogen stripper/reactor 23. Stream 21 flows downwardly through a bed of hydrotreating catalyst 52, while being contacted with countercurrent flowing hydrogen from stream 32.

The overhead stream 26 from hot hydrogen stripper/reactor 52 contains hydrogen, ammonia and hydrogen sulfide, along with light gases and naphtha. It is cooled in exchanger 27. Water is injected (stream 36) into the stream 26 to remove most of the ammonia as ammonium bisulfide solution (ammonia and hydrogen sulfide react to form ammonium bisulfide which is converted to solution by water injection). The stream is then air cooled by cooler 45. The effluent from the air cooler enters the cold high pressure separator 17. Hydrogen, light hydrocarbonaceous gases, and hydrogen sulfide are removed overhead through stream 19. Hydrogen sulfide is removed (stream 51) from the stream in the hydrogen sulfide absorber 20. Ammonia and hydrogen sulfide is removed with the sour water stream (stream 48) from the cold high pressure separator 17. Stream 40, which contains hydrogen, is compressed in compressor 30 and splits into streams 29 and 31. Stream 31 is diverted from stream 29 for use as interstage quench. Streams 4 and 5 are diverted from stream 31. Stream 29, containing hydrogen, is combined with hydrogen stream 42 prior to combining with oil feed stream 1.

Make-up hydrogen 38 is compressed and sent to four separate locations, upstream of reactor 2 to combine with feed stream 1 (through stream 42), to the hot high pressure separator 8 through stream 46, to the hot hydrogen stripper/reactor 23, and to the middle distillate upgrader (stream 35) to combine with recycle diesel or kerosene or to be used as interstage quench. Stream 38, containing make-up hydrogen, passes to the make-up hydrogen compressor 37. From stream 41, which exits compressor 37 containing compressed hydrogen, streams 35, 42 and 46 are diverted.

In this embodiment, the middle distillate upgrading reactor 12 operates at lower pressure than the first stage reactor 2. Liquid (stream 24) from the hot hydrogen stripper 52 is reduced in pressure (via valve 28) and is combined with make-up hydrogen (stream 35) after the second stage of compression of the make-up hydrogen compressor 37. Recycle kerosene or diesel (stream 50) may be added at this point. The mixture is sent after preheat (in exchanger 25) to the middle distillate upgrader 12, which is preferably loaded with one or more beds of noble metal catalyst 13. Part of the make-up hydrogen is available as quench (stream 47) between the beds for multiple bed application. Reactor effluent (stream 14) is cooled in a series of heat exchangers 15 and sent to a cold high pressure separator 49.

Overhead vapor 38 from the cold high pressure separator 49 is essentially high-purity hydrogen with a small amount of hydrocarbonaceous light gases. The vapor is sent to the make-up hydrogen compressor 37. Compressed make-up hydrogen (stream 29) is sent to the high pressure reactor 2, the high pressure separator 8, and hot hydrogen stripper/reactor 23. Bottoms (stream 18) from the cold high-pressure separator 17 is sent to the fractionation section (stream 53) after pressure reduction.

Stream 14, which is the effluent from the middle distillate upgrader 12, is used to heat the other process streams in the unit (see exchanger 15) and passes to the cold high pressure separator 49. The liquid effluent of cold high pressure separator 49, stream 39, passes to fractionation.

Feeds

A wide variety of hydrocarbon feeds may be used in the instant invention. Typical feedstocks include any heavy or synthetic oil fraction or process stream having a boiling point above 300° F. (150° C.). Such feedstocks include vacuum gas oils, heavy atmospheric gas oil, delayed coker gas oil, visbreaker gas oil, demetallized oils, vacuum residua, atmospheric residua, deasphalted oil, Fischer-Tropsch streams, FCC streams, etc.

For the first reaction stage, typical feeds will be vacuum gas oil, heavy coker gas oil or deasphalted oil. Lighter feeds such as straight run diesel, light cycle oil, light coker gas oil or visbroken gas oil can be introduced upstream of the hot hydrogen stripper/reactor 23.

Products

FIGS. 1 and 2 depict two different versions of the instant invention, directed primarily to high quality middle distillate production as well as to production of heavy hydrotreated gas oil.

The process of this invention is especially useful in the production of middle distillate fractions boiling in the range of about 250° F.–700° F. (121° C.–371° C.). A middle distillate fraction is defined as having a boiling range from about 250° F. to 700° F. At least 75 vol %, preferably 85 vol %, of the components of the middle distillate have a normal boiling point of greater than 250° F. At least about 75 vol %, preferably 85 vol %, of the components of the middle distillate have a normal boiling point of less than 700° F. The term "middle distillate" includes the diesel, jet fuel and kerosene boiling range fractions. The kerosene or jet fuel boiling point range refers to the range between 280° F. and 525° F. (138° C.–274° C.). The term "diesel boiling range" refers to hydrocarbons boiling in the range from 250° F. to 700° F. (121° C.–371° C.).

Gasoline or naphtha may also be produced in the process of this invention. Gasoline or naphtha normally boils in the range below 400° F. (204° C.), or $C_5$-. Boiling ranges of various product fractions recovered in any particular refinery will vary with such factors as the characteristics of the crude oil source, local refinery markets and product prices.

Heavy diesel, another product of this invention, usually boils in the range from 550° F. to 750° F.

Conditions

Hydroprocessing conditions is a general term which refers primarily in this application to hydrocracking or hydrotreating, preferably hydrocracking. The first stage reactor, as depicted in FIGS. 1 and 2, may be either a VGO hydrotreater or a moderate severity hydrocracker.

Hydrotreating conditions include a reaction temperature between 400° F.–900° F. (204° C.–482° C.), preferably 650° F.–850° F. (343° C.–454° C.); a pressure from 500 to 5000 psig (pounds per square inch gauge) (3.5–34.6 MPa), preferably 1000 to 3000 psig (7.0–20.8 MPa); a feed rate (LHSV) of 0.5 $hr^{-1}$ to 20 $hr^{-1}$ (v/v); and overall hydrogen consumption 300 to 5000 scf per barrel of liquid hydrocarbon feed (53.4–356 $m^3/m^3$ feed).

In the embodiment shown in FIG. 1, the first stage reactor and the middle distillate upgrader are operating at the same pressure. In the embodiment shown in FIG. 2, the middle distillate upgrader is operating at a lower pressure than the first stage reactor.

Typical hydrocracking conditions include a reaction temperature of from 400° F.–950° F. (204° C.–510° C.), preferably 650° F.–850° F. (343° C.–454° C.). Reaction pressure ranges from 500 to 5000 psig (3.5–34.5 MPa), preferably 1500 to 3500 psig (10.4–24.2 MPa). LHSV ranges from 0.1 to 15 $hr^{-1}$ (v/v), preferably 0.25–2.5 $hr^{-1}$. Hydrogen consumption ranges from 500 to 2500 scf per barrel of liquid hydrocarbon feed (89.1–445 $m^3$ $H_2/m^3$ feed).

Catalyst

A hydroprocessing zone may contain only one catalyst, or several catalysts in combination.

The hydrocracking catalyst generally comprises a cracking component, a hydrogenation component and a binder. Such catalysts are well known in the art. The cracking component may include an amorphous silica/alumina phase and/or a zeolite, such as a Y-type or USY zeolite. Catalysts having high cracking activity often employ REX, REY and USY zeolites. The binder is generally silica or alumina. The hydrogenation component will be a Group VI, Group VII, or Group VIII metal or oxides or sulfides thereof, preferably one or more of molybdenum, tungsten, cobalt, or nickel, or the sulfides or oxides thereof. If present in the catalyst, these hydrogenation components generally make up from about 5% to about 40% by weight of the catalyst. Alternatively, platinum group metals, especially platinum and/or palladium, may be present as the hydrogenation component, either alone or in combination with the base metal hydrogenation components molybdenum, tungsten, cobalt, or nickel. If present, the platinum group metals will generally make up from about 0.1% to about 2% by weight of the catalyst.

Hydrotreating catalyst, if used, will typically be a composite of a Group VI metal or compound thereof, and a Group VIII metal or compound thereof supported on a porous refractory base such as alumina. Examples of hydrotreating catalysts are alumina supported cobalt-molybdenum, nickel sulfide, nickel-tungsten, cobalt-tungsten and nickel-molybdenum. Typically, such hydrotreating catalysts are presulfided.

EXAMPLE

POST-HYDROTREATING OF MILD HYDROCRACKER DISTILLATES FOR CETANE UPGRADING

| Feed | Mild Hydrocracked Distillate from Vacuum Gas Oil/ Coker Gas Oil Blend | Mild Hydrocracked Distillate from Middle Eastern Vacuum Gas Oil |
|---|---|---|
| Mild Hydrocracking Conversion | 30 Liquid Volume % <680° F. | 31 Liquid Volume % <700° F. |
| Hydrotreating Catalyst | Noble metal/Zeolite | Base metal/Alumina |
| Hydrotreating Conditions: | | |
| Catalyst Bed Temperature, ° F. | 594 | 720 |
| LHSV, 1/hr | 1.5 | 2.0 |
| Gas/Oil Ratio, SCF/B | 3000 | 5000 |
| $H_2$ Partial Pressure, psia | 800 | 1900 |
| Cetane Uplift (typical) | 7 to 15 | 2 to 7 |

The Table above illustrates the effectiveness of upgrading the effluent of the first stage reactor, which has been mildly hydrocracked. The effluent is hydrotreated in the middle distillate upgrader. Cetane uplift (improvement) is greater, and at less severe conditions, using a catalyst having a noble metal hydrogenation component with a zeolite cracking component than when using a catalyst having base metal hydrogenation components on alumina, an amorphous support. Cetane uplift can be higher if external diesel range feeds (7) are added upstream of Hot High Pressure Separator 44.

What is claimed is:

1. A method for hydroprocessing a hydrocarbon feedstock, said method employing multiple hydroprocessing zones within a single reaction loop, each zone having one or more catalyst beds, comprising the following steps:

(a) passing a hydrocarbonaceous feedstock to a first hydroprocessing zone having one or more beds containing hydroprocessing catalyst, the hydroprocessing zone being maintained at hydroprocessing conditions, wherein the feedstock is contacted with catalyst and hydrogen;

(b) passing the effluent of step (a) directly to a hot high pressure separator, wherein the effluent is contacted with a hot, hydrogen-rich stripping gas to produce a vapor stream comprising hydrogen, hydrocarbonaceous compounds boiling at a temperature below the boiling range of the hydrocarbonaceous feedstock, hydrogen sulfide and ammonia and a liquid stream comprising hydrocarbonaceous compounds boiling approximately in the range of said hydrocarbonaceous feedstock;

(c) passing the vapor stream of step (b) after cooling and partial condensation, to a hot hydrogen stripper containing at least one bed of hydrotreating catalyst, where it is contacted countercurrently with hydrogen, thereby producing an overhead vapor stream and a liquid stream, the liquid stream of step (b) being passed to fractionation;

(d) passing the overhead vapor stream from the hot hydrogen stripper/reactor of step (c), after cooling and contact with water, the overhead vapor stream comprising hydrogen, ammonia, and hydrogen sulfide, along with light gases and naphtha to a cold high pressure separator, where hydrogen, hydrogen sulfide, and light hydrocarbonaceous gases are removed overhead, ammonia is removed from the cold high pressure separator as ammonium bisulfide in the sour water stripper, and naphtha and middle distillates are passed to fractionation;

(e) passing the liquid stream from the hot hydrogen stripper/reactor of step (c) to a second hydroprocessing zone, the second hydroprocessing zone containing at least one bed of hydroprocessing catalyst suitable for aromatic saturation and ring opening, wherein the liquid is contacted under hydroprocessing conditions with the hydroprocessing catalyst, in the presence of hydrogen;

(f) passing the overhead from the cold high pressure separator of step (d) to an absorber, where hydrogen sulfide is removed before hydrogen is compressed and recycled to hydroprocessing vessels within the loop; and (g) passing the effluent of step (e) to the cold high pressure separator of step (d).

2. The process of claim 1, wherein the hydroprocessing conditions of step 1(*a*) comprise a reaction temperature of from 400° F.–950° F. (204° C.–510° C.), a reaction pressure in the range from 500 to 5000 psig (3.5–34.5 MPa), an LHSV in the range from 0.1 to 15 $hr^{-1}$ (v/v), and hydrogen consumption in the range from 500 to 2500 scf per barrel of liquid hydrocarbon feed (89.1–445 $m^3$ $H_2/m^3$ feed).

3. The process of claim 2, wherein the hydroprocessing conditions of step 1(*a*) preferably comprise a temperature in the range from 650° F.–850° F. (343° C.–454° C.), reaction pressure in the range from 1500–3500 psig (10.4–24.2 MPa), LHSV in the range from 0.25 to 2.5 $hr^{-1}$, and hydrogen consumption in the range from 500 to 2500 scf per barrel of liquid hydrocarbon feed (89.1–445 $m^3$ $H_2/m^3$ feed).

4. The process of claim 1, wherein the hydroprocessing conditions of step 1(*e*) comprise a reaction temperature of from 400° F.–950° F. (204° C.–510° C.), a reaction pressure in the range from 500 to 5000 psig (3.5–34.5 MPa), an LHSV in the range from 0.1 to 15 $hr^{-1}$ (v/v), and hydrogen consumption in the range from 500 to 2500 scf per barrel of liquid hydrocarbon feed (89.1–445 $m^3$ $H_2/m^3$ feed).

5. The process of claim 4, wherein the hydroprocessing conditions of step 1(*e*) preferably comprise a temperature in the range from 650° F.–850° F. (343° C.–454° C.), reaction pressure in the range from 1500–3500 psig (10.4–24.2 MPa), LHSV in the range from 0.25 to 2.5 $hr^{-1}$, and hydrogen consumption in the range from 500 to 2500 scf per barrel of liquid hydrocarbon feed (89.1–445 $m^3$ $H_2/m^3$ feed).

6. The process of claim 1, wherein the feed to step 1(*a*) comprises hydrocarbons boiling in the range from 500° F. to 1500° F.

7. The process of claim 1, wherein the feed is selected from the group consisting of vacuum gas oil, heavy atmospheric gas oil, delayed coker gas oil, visbreaker gas oil, FCC light cycle oil, and deasphalted oil.

8. The process of claim 1, wherein the cetane number improvement occurring in step 1(*e*) ranges from 2to 15.

9. The process of claim 1, wherein the hydroprocessing catalyst comprises both a cracking component and a hydrogenation component.

10. The process of claim 9, wherein the hydrogenation component is selected from the group consisting of Ni, Mo, W, Pt and Pd or combinations thereof.

11. The process of claim 9, wherein the cracking component may be amorphous or zeolitic.

12. The process of claim 11, wherein the zeolitic component is selected from the group consisting of Y, USY, REX, and REY zeolites.

13. The process of claim 1, wherein the second hydroprocessing zone of step 1(*e*) is maintained at the same pressure as the first hydroprocessing zone of step 1(*a*).

14. The process of claim 1, wherein the second hydroprocessing zone of step 1(*e*) is maintained at a lower pressure than that of the first hydroprocessing zone of step 1(*a*).

15. The process of claim 14, wherein the second hydroprocessing zone of step 1(*e*) is maintained at a pressure that is from 500 to 1500 psi lower than the pressure in the first hydroprocessing zone.

* * * * *